United States Patent [19]

Stuart et al.

[11] 3,965,387

[45] June 22, 1976

[54] ELECTRIC LAMP AND THERMAL SWITCH THEREFORE

[75] Inventors: Karl D. Stuart, Wickliffe; Juris Sulcs, East Cleveland; P. Kennard Wright, III, Cleveland Heights, all of Ohio

[73] Assignee: General Electric Company, Schenectady, N.Y.

[22] Filed: June 24, 1974

[21] Appl. No.: 482,335

[52] U.S. Cl. ..... 315/47; 315/60; 315/73; 315/100; 200/67 D; 337/85; 337/88

[51] Int. Cl.[2] ..... H01J 7/44; H01J 13/46; H01J 17/34; H01J 19/78

[58] Field of Search ..... 315/47, 60, 73, 100, 315/104; 313/229; 200/DIG. 27, DIG. 28, 61.76, 67 D; 337/85, 88

[56] References Cited

UNITED STATES PATENTS

| | | | |
|---|---|---|---|
| 1,146,637 | 11/1913 | Massa | 200/DIG. 27 |
| 1,797,886 | 3/1931 | Thomas | 200/DIG. 28 |
| 2,267,463 | 12/1941 | Hood et al. | 337/85 |
| 2,278,837 | 4/1942 | De Castro | 315/73 X |
| 2,462,335 | 2/1949 | Reinhardt | 315/73 |
| 2,704,814 | 3/1955 | White | 200/61.76 X |
| 3,021,406 | 2/1962 | Graf et al. | 200/67 DX |
| 3,207,875 | 9/1965 | Bagnall et al. | 337/88 X |
| 3,226,597 | 12/1965 | Green | 315/60 |
| 3,284,597 | 11/1966 | Hollis | 337/88 |
| 3,307,069 | 2/1967 | Fraser et al. | 315/60 |
| 3,349,206 | 11/1967 | Won Kim | 200/67 DX |
| 3,445,721 | 5/1969 | Waymouth | 315/60 |
| 3,619,710 | 11/1971 | Waymouth | 315/73 |

*Primary Examiner*—Saxfield Chatmon, Jr.
*Attorney, Agent, or Firm*—Ernest W. Legree; Lawrence R. Kempton; Frank L. Neuhauser

[57] ABSTRACT

An improved thermal switch permitting large temperature excursions beyond the design closure temperature without stressing the switch material beyond its elastic limits. It combines a bimetal portion with a spring portion through which movement is transmitted, the former providing sufficient deformation for closure at design temperature, and the latter accommodating excess deformation beyond closure caused by high temperature. It is particularly useful in metal halide lamps having gas filled outer envelopes and requiring shorting of an auxiliary starting electrode to the adjacent main electrode during operation.

8 Claims, 8 Drawing Figures

ELECTRIC LAMP AND THERMAL SWITCH THEREFORE

BACKGROUND OF THE INVENTION

The invention relates to an improved thermal switch which closes upon heating to a given temperature and which can safely withstand a temperature much higher than that of closure. Such switches are often used in high intensity discharge lamps wherein they are located in the interenvelope space between the inner arc tube of fused silica and the outer glass envelope.

In metal halide lamps in which the fill comprises mercury and the halides of various metals including sodium, electrolysis of the fused silica in the region between the starter and the adjacent main electrode is a problem. A solution thereto, widely adopted in the lamp industry, was provided by U.S. Pat. No. 3,226,597 — Green. It consists in a bimetal switch located in the interenvelope space between the arc tube and the outer envelope, which short circuits the starter electrode to the adjacent main electrode after the lamp has heated up to operating temperature.

Metal halide lamps have generally utilized evacuated outer envelopes to minimize heat losses from the fused silica arc tube. The thermal switch is heated by conduction from the arc tube structure and by radiant energy, so that the switch temperature is determined by the lamp wattage and is substantially independent of the position or orientation in which the lamp is operated. A simple U-shaped switching element could be designed to accommodate the temperature excursions normally encountered over the operating wattage range of the lamps without exceeding the thermal and mechanical limitations of the commercially available bimetal materials. Such material, often termed thermostat metal, is a composite, usually in the form of strip or sheet, made up of two or more metallic layers of different coefficients of expansion permanently bonded together. A nickel-iron alloy is commonly used for the low expansion component, and a nickel-chrome steel alloy for the high expansion component. When the temperature is raised, the relative lengths of the two components change causing the material to curve or bend.

Various considerations including long term performance, processing economies whereby to avoid the cost of exhaust, and safety considerations in the case of physically large lamps, now make it desirable to provide a gas filling within the outer protective envelope. A consequence thereof is to introduce the variable of convective heating in lamp performance which has a strong effect on the operating temperature of the bimetal element. For practical reasons of ease of mounting and manufacturing, the bimetal element is normally located at the end of the arc tube which has the starter electrode. In gas filled lamps, the arc tube is arranged to have the starter electrode uppermost. Under these circumstances, convective heating of the bimetal switch during operation If greatly influenced by the operating position or orientation of the lamp from vertical to horizontal. Consequently the switch must function over a much greater range of temperature than previously when wattage variation alone was the governing factor.

In a bimetal switch which is normally closed and opens upon heating and wherein there is no restraint upon further deformation, overheating does not create any particular problem. However where the switch is normally open and closes upon heating in such fashion that contact closure imposes a restraint on movement of the bimetal, excessive temperature excursions may stress the bimetal material beyond its elastic limits resulting in permanent deformation of the switch. When the switch deforms, it may no longer close at the design closure temperature. A metal halide lamp wherein the switch fails to close may become inoperative as a result of electrolysis after a few hundred hours of operation.

SUMMARY OF THE INVENTION

The object of the invention is to provide a new and improved thermal switch design particularly suitable for an arc lamp having a gas filled outer envelope and which will allow large temperature excursions beyond the switch closure temperature.

According to our invention, the thermal switch combines a bimetal portion with a spring portion through which contact motion is transmitted and optionally amplified. The bending of the bimetal provides sufficient movement for closure at design temperature. Further bending of the bimetal by excess temperature is accommodated by flexure of the spring portion in a direction to offset the movement of the bimetal, thereby avoiding excessive stress and permanent deformation of the bimetal.

In a preferred embodiment, a bimetal strip is fastened to the main electrode inlead and a straight springy conductor is attached to the free end of the bimetal strip and takes a position tangential to the arc of the strip as temperature increases. When the tangent intersects the location of the starter electrode inlead, electrical closure is effected. If the temperature is raised beyond closure temperature, the springy conductor simply bends to accommodate further curving of the bimetal strip without exceeding the allowable working stress of either the bimetal strip or the springy conductor.

DETAILED DESCRIPTION

Figure 1:
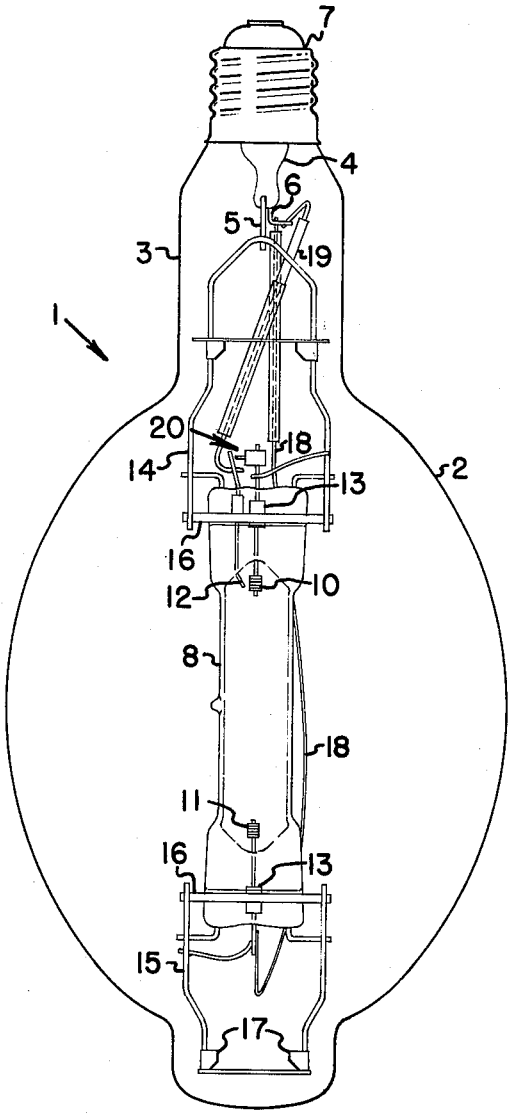
FIG. 1 is a side view of a metal halide lamp provided with a thermal switch embodying the invention.

Referring to FIG. 1, a typical metal halide vapor arc lamp 1 in which the invention may be embodied comprises an outer vitreous envelope or jacket 2 of bulged tubular form having a neck portion 3 closed by a reentrant stem 4. Stiff inlead wires 5, 6 extending through the stem are connected at their outer ends to the contacts of a screw base 7 and have connections from their inner ends to the inner arc tube 8. The arc tube is made of fused silica and has sealed therein at opposite ends main arcing electrodes 10, 11 plus an auxiliary starting electrode 12. The electrodes are supported on inleads which include intermediate thin molybdenum foil sections 13 hermetically sealed through the flattened or pinched ends of the arc tube.

The arc tube is supported within the outer envelope by a divided or two-part mount, 14 at the base end and 15 at the dome end. Each part comprises a pair of longitudinally extending support rods bridged by metal straps 16 which clamp about the pinched ends of the arc tube. The base end mount part is welded to inlead 5 and serves as a conductor to main electrode 10. The dome end mount part is restrained in the tubular end of the envelope by a pair of springy blades 17. Main electrode 11 is connected to inlead 6 by curving wire 18. Starting electrode 12 is connected to inlead 6 through current limiting resistor 19. The two-part mount construction illustrated may be in accordance with the teachings of U.S. Pat. No. 3,558,951 — Kramel et al.

In a metal halide lamp corresponding to that illustrated and produced commercially by applicant's assignee, the arc tube contains argon at a pressure of about 25 torr, a quantity of mercury substantially vaporized during operation and exerting a partial pressure of 1 to 15 atmospheres, a quantity of sodium iodide in excess of that vaporized at the operating temperature, plus smaller amounts of thallium iodide and indium iodide. Alternatively, the arc tube may contain scandium iodide and thorium iodide in lieu of thallium iodide and indium iodide. The outer envelope or jacket is filled with an inactive gas, suitably nitrogen at about ½ of an atmosphere pressure.

Figure 2:
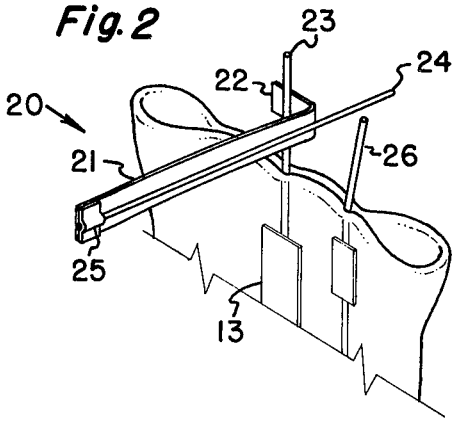
FIG. 2 is an enlarged perspective view of the switch mounted on the upper end of the arc tube.

The invention is more particularly concerned with the construction of thermal switch 20 which short-circuits auxiliary electrode 12 to main electrode 10 after the lamp has warmed up. Such short circuiting follows the teachings of U.S. Pat. No. 3,226,597 — Green, to prevent electrolysis of the fused silica in the region of the inleads to electrodes 10 and 12. As best seen in FIGS. 2, switch 20 comprises a bimetal strip 21 having a root end portion 22 bent over at right angles and welded to inlead 23 leading to main electrode 10. A straight springy wire conductor 24 is attached to the free or distal end of the bimetal by means of a small clamp 25 welded thereto and retroverts along the side of the bimetal which becomes convex upon heating. Conductor 24 forms a tangent to the arc of the bimetal and is disposed to engage inlead 26 of auxiliary electrode 12 as it sweeps in a plane transverse to the axis of the arc tube.

Figure 3:
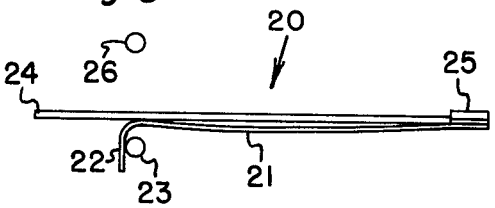
FIGS. 3, 4 and 5 are sequential plan views of the switch in three positions corresponding to room temperature, closure temperature, and excess temperature.
Figure 4:
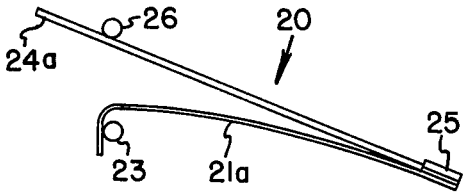
Figure 5:
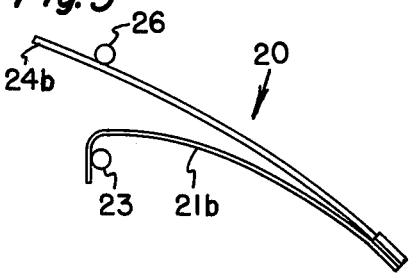

FIGS. 3, 4, and 5 illustrate the manner of operation of the switch. At room temperature as illustrated in FIG. 3, bimetal element 21 is straight or has a slight reverse bend and is oriented so that it will curl away from inlead 26 of the starter electrode as it is heated. With increasing temperature, the bimetal assumes the shape of a circular arc as shown at 21*a* in FIG. 4. Straight wire conductor 24 attached at 25 to the free end of the bimetal maintains a position tangential to the arc as the temperature increases. When the tangent finally touches inlead 26 to the starter electrode as indicated at 24*a* in FIG. 4, electrical closure is effected. If the temperature is raised above closure temperature, the bimetal continues bending as indicated at 21*b* in FIG. 5 and the flexible conductor bends in the same direction as indicated at 24*b* in order to accommodate the additional curvature.

The closure temperature is determined by the bimetal flexivity, that is the change of curvature in response to temperature change, and the lengths of the bimetal strip and of the flexible conductor chosen in relation to the initial gap to be closed. The flexible conductor is of a size to provide adequate current carrying capacity and of bending moment such as not to overstress the bimetallic strip at the maximum temperature to which the switch could be subjected. Of course the flexible conductor must also be chosen of a diameter (or thickness) and material such that at the maximum temperature and deflection it will not be stressed beyond its elastic limit. We have found that these design constraints can readily be satisfied with common thermostat metals in dimensions practical for lamp use.

In the preferred design illustrated in FIGS. 1 to 5, a bimetal element about 20 millimeters long provides sufficient movement to effect closure of the illustrated gap at the lamp's minimum operating temperature. For the springy wire conductor 24, a thin tungsten wire about .015 inch diameter is adequate for current carrying capacity and has sufficient flexture to prevent overstressing the bimetal after closure up to the maximum operating temperature. In the prior art U-shaped bimetal switch, excess temperature over closure temperature was limited to approximately 100°F (56°C), and greater temperature excursions stress the bimetal beyond its elastic limits resulting in permanent deformation. But in a lamp such as illustrated with gas filling of the outer envelope, in order to assure closure of the switch in the most unfavorable position for heating, provision must be made for overheating to the extent of 300°C. This is readily accomplished by the illustrated switch embodying the invention.

While the bimetal element has been shown welded to inlead 23 at one end and having the springy wire conductor welded to it at the distal end, such welding is not essential and crimped mechanical junctions would suffice as the circuit impedance is high and moderate contact conductances are adequate for the function.

Figure 6:
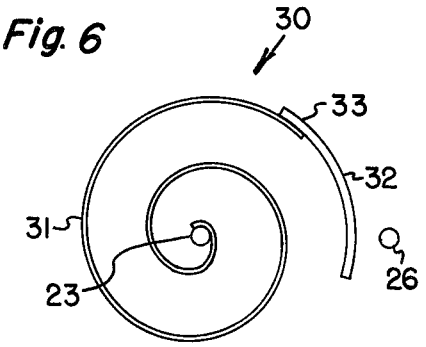
FIGS. 6, 7, and 8 are plan views of a thermal switch in a spiral modification and in a corresponding temperature sequence.
Figure 7:
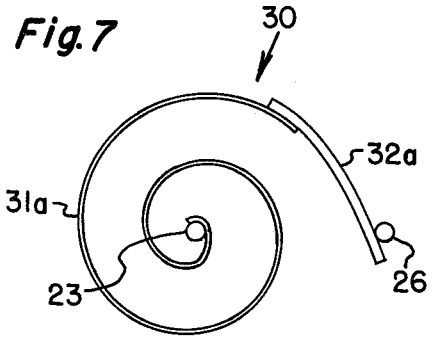
Figure 8:
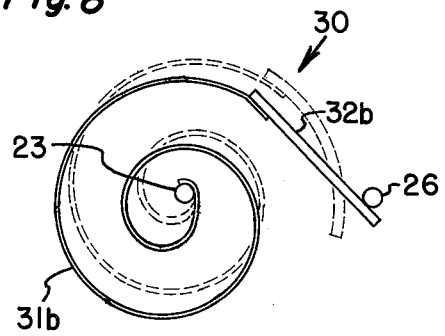

Thermal switch 30 illustrated in FIGS. 6 to 8 is a variant of the invention permitting a more compact construction. It comprises a springy ribbon conductor 31 curled into a spiral and welded to inlead 23 at its origin. A bimetal strip 32 is welded at 33 to the free end of conductor 31 and extends the curve of the spiral in the direction of inlead 26.

FIG. 6 shows the rest or room temperature condition of the switch wherein bimetal 32 is curved upon itself to the left and does not engage inlead 26, the switch being open. With rising temperature, the bimetal starts to unbend and to straighten out as indicated at 32*a* in FIG. 7, until it contacts inlead 26. At this point the switch is closed and there has as yet been substantially no movement of the springy conductor 31*a*. Should the lamp orientation be such that the switch temperature continues to rise, the bimetal will unbend further and may straighten out completely as indicated at 32*b* in FIG. 8 or may even go into a reverse curve. Since the free end of the bimetal has already engaged inlead 26, the excess movement is simply absorbed by the spiral springy conductor which, as shown in FIG. 8, displaces itself from the original dotted line position to that indicated in solid lines at 31*b*. The illustrated combination of a bimetal with a spiral spring permits the accommodation of very large temperature excursions beyond closure without subjecting either the bimetal or the spiral spring to stress beyond the elastic limits which would result in permanent deformation of the switch.

What we claim as new and desire to secure by Letters Patent of the United States is:

1. An electric discharge lamp comprising:

an outer envelope, an inner arc tube located within said outer envelope and containing an ionizable medium, said arc tube having electrodes at opposite ends including at one end a main electrode plus an auxiliary starting electrode supported on inleads sealed through the tube wall, and a thermal switch within said outer envelope comprising a bimetal element having its root end fastened to one of said inleads, a springy conductor attached to the distal end of said bimetal and retroverting alongside thereof, said conductor being located on the convex side of the bimetal as it bends with rising temperature, said bimetal and conductor being disposed so that the free end of the conductor engages the other of said inleads to short-circuit said main and auxiliary electrodes together at switch closure, said conductor bending in the same direction as the bimetal to accommodate further curvature of the bimetal resulting from heating thereof beyond closure temperature whereby neither the bimetal nor the spring conductor is stressed beyond its elastic limit.

2. An electric lamp as in claim 1 wherein the bimetal element is a substantially straight strip, and the springy conductor retroverting along the side thereof that becomes convex upon heating extends tangentially thereto and swings in a curve that contacts the other inlead upon heating to closure temperature.

3. A combination as in claim 1 wherein the interenvelope space is gas-filled and the arc tube is of fused silica and includes a halide of sodium in its fill.

4. A normally open thermal switch permitting large temperature excursions beyond design closure temperature comprising:

a bimetal member and a springy non-bimetal conductor member fastened together at one end, the other end of one of said members being fastened to a fixed lead, said members being arranged such that the other end of the other member moves into contact with another fixed lead upon heating of the switch to closure temperature, excess movement of the bimetal resulting from a temperature excursion beyond closure temperature being absorbed by distortion of the springy conductor whereby neither the bimetal nor the springy conductor is stressed beyond its elastic limit.

5. A thermal switch as in claim 4 wherein the bimetal member has its root end fastened to the fixed lead, and the springy conductor fastened to the distal end of the bimetal retroverts along the side of the bimetal which becomes convex upon heating.

6. A thermal switch as in claim 4 wherein the springy conductor forms a spiral and is fastened to the fixed lead at its origin, the bimetal fastened to the other end of the springy conductor forming an extension of the spiral, the free end of the bimetal being disposed to engage the other fixed lead when it straightens out on heating.

7. A normally open thermal switch permitting large temperature excursions beyond design closure temperature comprising:

a bimetal element fastened to a fixed lead at its root end, a springy conductor not a bimetal attached to the distal end of said bimetal and retroverting alongside thereof, said conductor being located on the convex side of the bimetal as it bends with rising temperature, said bimetal and conductor being disposed so that the free end of the conductor engages another fixed lead to effect electrical closure of the switch as the bimetal bends, said conductor bending in the same direction as the bimetal to accommodate further curvature of the bimetal resulting from heating thereof beyond closure temperature whereby neither the bimetal nor the spring conductor is stressed beyond its elastic limit.

8. A thermal switch as in claim 7 wherein the bimetal element is a substantially straight strip, and the springy conductor retroverting along the side thereof that becomes convex upon heating extends tangentially thereto and swings in a curve that contacts the other fixed lead upon heating to closure temperature.

* * * * *